US007723909B2

(12) United States Patent
Yamaguchi et al.

(10) Patent No.: US 7,723,909 B2
(45) Date of Patent: May 25, 2010

(54) ELECTRON EMITTER FORMED OF A DIELECTRIC MATERIAL CHARACTERIZED BY HAVING HIGH MECHANICAL QUALITY FACTOR

(75) Inventors: Hirofumi Yamaguchi, Komaki (JP); Kei Sato, Tokai (JP)

(73) Assignee: NGK Insulators, Ltd., Nagoya (JP)

( * ) Notice: Subject to any disclaimer, the term of this patent is extended or adjusted under 35 U.S.C. 154(b) by 774 days.

(21) Appl. No.: 11/471,938

(22) Filed: Jun. 21, 2006

(65) Prior Publication Data

US 2006/0290255 A1 Dec. 28, 2006

(30) Foreign Application Priority Data

Jun. 23, 2005 (JP) ..... 2005-183308

(51) Int. Cl.
*H01J 19/06* (2006.01)
*H01J 1/14* (2006.01)

(52) U.S. Cl. ..... 313/311; 313/310; 313/495; 252/62.9 PZ

(58) Field of Classification Search ..... 313/309–311, 313/495–497; 252/62.9 PZ
See application file for complete search history.

(56) References Cited

U.S. PATENT DOCUMENTS

| | | | | |
|---|---|---|---|---|
| 3,779,925 | A | 12/1973 | Ouchi et al. | |
| 4,210,546 | A | 7/1980 | Ouchi et al. | |
| 5,453,661 | A * | 9/1995 | Auciello et al. | 313/497 |
| 5,747,926 | A * | 5/1998 | Nakamoto et al. | 313/495 |
| 7,276,462 | B2 * | 10/2007 | Yamaguchi et al. | 252/62.9 PZ |
| 2004/0090398 | A1 | 5/2004 | Takeuchi et al. | |
| 2005/0073233 | A1 | 4/2005 | Takeuchi et al. | |
| 2005/0073261 | A1 | 4/2005 | Takeuchi et al. | |
| 2005/0104504 | A1 * | 5/2005 | Takeuchi et al. | 313/495 |
| 2005/0116603 | A1 | 6/2005 | Takeuchi et al. | |

FOREIGN PATENT DOCUMENTS

| | | | |
|---|---|---|---|
| EP | 1 523 026 | A2 | 4/2005 |
| JP | 07-147131 | A1 | 6/1995 |
| JP | 11185600 | A * | 7/1999 |
| JP | 2000-285801 | A1 | 10/2000 |
| JP | 2002-154872 | A1 | 5/2002 |
| JP | 2004-146365 | A1 | 5/2004 |
| JP | 2004-172087 | A1 | 6/2004 |
| JP | 2005-116232 | A1 | 4/2005 |
| JP | 2005-142134 | A1 | 6/2005 |

* cited by examiner

*Primary Examiner*—Mariceli Santiago
(74) *Attorney, Agent, or Firm*—Burr & Brown

(57) ABSTRACT

A dielectric-film-type electron emitter includes an emitter section, a first electrode, and a second electrode. The emitter section is formed of a thin layer of a polycrystalline dielectric material. The dielectric material constituting the emitter section is formed of a material having high mechanical quality factor (Qm). Specifically, the dielectric material has a Qm higher than that of a so-called low-Qm material (a material having a Qm of 100 or less). The Qm of the dielectric material is preferably 300 or more, more preferably 500 or more.

7 Claims, 7 Drawing Sheets

ELECTRON EMITTER FORMED OF A DIELECTRIC MATERIAL CHARACTERIZED BY HAVING HIGH MECHANICAL QUALITY FACTOR

BACKGROUND OF THE INVENTION

1. Field of the Invention

The present invention relates to an electron emitter which is configured such that it can emit electrons through application of a predetermined electric field.

2. Description of the Related Art

This type of an electron emitter is configured such that when a predetermined electric field is applied to an electron emission section (emitter section) in a vacuum having a predetermined vacuum level, electrons are emitted from the electron emission section (emitter section).

Such an electron emitter is employed as an electron beam source in various apparatuses that utilize electron beams. Specific examples of such an apparatus include a display (in particular, a field emission display (FED)), an electron beam irradiation apparatus, a light source device, an electronic-component-manufacturing apparatus, and an electronic circuit component.

In application to an FED, a plurality of electron emitters are two-dimensionally arrayed. In addition, a plurality of phosphors corresponding to the electron emitters are arrayed with a predetermined gap therebetween.

In an FED having such a configuration, among the two-dimensionally arrayed electron emitters, certain electron emitters are selectively driven so as to emit electrons therefrom. The emitted electrons collide with phosphors corresponding to the driven electron emitters. The phosphors hit by the electrons fluoresce, thereby providing a display.

Electron beam irradiation apparatuses are employed for, for example, the following applications: solidification of an insulating film during wafer lamination in a semiconductor chip production process; hardening or drying of printing ink; and sterilization of a packaged medical instrument. Electron beam irradiation apparatuses are superior to ultraviolet-ray irradiation apparatuses, which have conventionally been employed for the aforementioned applications, in that high output is easily obtained, and radiated electron beams are absorbed by a target object in a highly efficient manner.

The aforementioned electron emitter is suitable for use in a light source device requiring high brightness and high efficiency. Specific examples of such a light source device include a light source device of a projector. As compared with an ultrahigh-pressure mercury lamp, which has conventionally been employed as such a light source device, a light source device employing the electron emitter is advantageous in that the device can attain miniaturization, long service life, high speed, and reduction of load imposed on the environment. A light source device employing the electron emitter can be employed in place of an LED. Specifically, such a light source device can be employed in, for example, an interior lighting apparatus, an automobile lamp, a traffic signal, or a backlight of a small liquid crystal display for cellular phones. Combination of the electron emitter and a phosphor can form a light-emitting device for exposure of a photosensitive drum of an electrophotographic apparatus.

When the electron emitter is applied to an electronic-component-manufacturing apparatus, the electron emitter is employed in, for example, an electron beam source of a film formation apparatus (e.g., an electron beam deposition apparatus), an electron source for plasma formation (for activation of gas, etc.) in a plasma CVD apparatus, or an electron source for gas decomposition.

Examples of electronic circuit components to which the electron emitter is applied include digital elements such as switches, relays, and diodes; and analog elements such as operational amplifiers. When the electron emitter is applied to such an electronic circuit component, current output can be increased, and amplification factor can be enhanced.

In addition to the aforementioned applications, the electron emitter is employed in, for example, vacuum micro devices such as high-speed switching devices operated at a frequency on the order of tera-Hz, and large-current outputting devices. The electron emitter is also suitable for use as an electron source for charging a dielectric material.

Specific examples of the electron emitter are disclosed in Japanese Patent Application Laid-Open (kokai) Nos. 07-147131, 2000-285801, 2004-146365, 2004-172087, 2005-116232, and 2005-142134.

The electron emission section (emitter section) of the electron emitter disclosed in Japanese Patent Application Laid-Open (kokai) No. 07-147131 or 2000-285801 is formed of a fine conductive electrode having a pointed tip end portion. Such a disclosed electron emitter includes a counter electrode provided so as to face the emitter section. The electron emitter is configured such that when a predetermined drive voltage is applied to the emitter section and the counter electrode, electrons are emitted from the tip end portion of the emitter section.

When the electron emitter disclosed in Japanese Patent Application Laid-Open (kokai) No. 07-147131 or 2000-285801 is to be produced, forming the aforementioned emitter section from such a fine conductive electrode requires micromachining that employs, for example, etching or fine forming (electro fine forming), and thus production of the electron emitter involves a complicated process.

In the electron emitter disclosed in Japanese Patent Application Laid-Open (kokai) No. 07-147131 or 2000-285801, a high level of drive voltage must be applied to the electron emitter for causing a sufficient quantity of electrons to be emitted from the tip end portion of the conductive electrode. Therefore, driving the electron emitter requires an expensive drive element (e.g., IC) which is applicable to high-voltage drive.

Thus, the electron emitter disclosed in Japanese Patent Application Laid-Open (kokai) No. 07-147131 or 2000-285801, which includes an emitter section formed of a conductive electrode, involves a problem in that high cost is required for producing the electron emitter per se, or a device employing the electron emitter.

In order to cope with the problem, there has been devised an electron emitter including an emitter section formed of a dielectric thin layer (see, for example, Japanese Patent Application Laid-Open (kokai) No. 2004-146365, 2004-172087, 2005-116232, or 2005-142134). Hereinafter, such an electron emitter may be referred to as a "dielectric-film-type electron emitter."

The dielectric-film-type electron emitter disclosed in Japanese Patent Application Laid-Open (kokai) No. 2004-146365, 2004-172087, 2005-116232, or 2005-142134 includes the aforementioned emitter section, a cathode electrode, and an anode electrode. The cathode electrode is formed on the front surface side of the emitter section. The anode electrode is formed on the reverse surface side of the emitter section, or on the front surface side of the emitter section at a position a predetermined distance away from the cathode electrode. Specifically, the dielectric-film-type electron emitter is configured such that an exposed portion of the front surface of the emitter section at which neither the cathode electrode nor the anode electrode is formed is present in the vicinity of a peripheral edge portion of the cathode electrode.

The dielectric-film-type electron emitter is operated as follows.

Firstly, in the first stage, voltage is applied between the cathode electrode and the anode electrode such that the cathode electrode is higher in electric potential. An electric field generated by the applied voltage brings the emitter section (in particular, the aforementioned exposed portion) into a predetermined polarization state.

Subsequently, in the second stage, voltage is applied between the cathode electrode and the anode electrode such that the cathode electrode is lower in electric potential. At this time, electrons are emitted from the peripheral edge portion of the cathode electrode, the polarization of the emitter section is inverted, and the electrons are accumulated on the front surface of the emitter section. When voltage is again applied such that the cathode electrode is higher in electric potential, the polarization of the emitter section is re-inverted, and the thus accumulated electrons are emitted by means of electrostatic repulsion between the electrons and dipoles. The electrons fly in a predetermined direction by means of an externally applied, predetermined electric field; i.e., the dielectric-film-type electron emitter emits electrons.

SUMMARY OF THE INVENTION

The present invention provides a dielectric-film-type electron emitter which, as compared with the aforementioned conventional electron emitters, emits electrons in a more efficient manner, provides higher output, and is operated at higher speed.

The dielectric-film-type electron emitter (hereinafter may be referred to simply as "electron emitter") of the present invention comprises an emitter section formed of a thin layer of a dielectric material having a high mechanical quality factor. Specifically, the emitter section has a mechanical quality factor (hereinafter may be referred to as a "Qm") higher than that of a so-called low-Qm material (i.e., a material having a Qm of 100 or less). The Qm of the emitter section is preferably 300 or more, more preferably 500 or more. A first electrode is formed on the front surface side (electron emission side) of the emitter section. A second electrode is formed on the reverse surface side of the emitter section; i.e., on the side opposite the front surface, or on the front surface side of the emitter section at a position a predetermined distance away from the first electrode. Specifically, the electron emitter of the present invention is configured such that an exposed portion of the front surface of the emitter section at which neither the first electrode nor the second electrode is formed is present in the vicinity of a peripheral edge portion of the first electrode.

In the electron emitter of the present invention having the aforementioned configuration, drive voltage having a predetermined waveform is applied between the first electrode and the second electrode. In accordance with the polarity of the thus applied drive voltage, electrons are temporarily accumulated on the front surface of the emitter section, and subsequently polarization is inverted at the emitter section, whereby the electrons are emitted to the exterior of the electron emitter by means of electrostatic repulsion between the electrons and dipoles on the front surface.

Electron emission characteristics of the electron emitter of the present invention, which is a static device that does not use mechanical deformation upon operation, can be controlled by Qm, which is generally a characteristic value of a material for representing the state of mechanical deformation of the material when voltage is applied thereto.

In the electron emitter of the present invention, preferably, a gap is formed between a peripheral portion of the first electrode and the front surface of the emitter section. In this preferred configuration, the peripheral portion of the first electrode assumes an overhanging shape, and the aforementioned gap is formed below the overhanging peripheral portion.

In this preferred configuration, an electric field generated on the front surface side of the emitter section through application of the drive voltage concentrates at the aforementioned gap. That is, most of the drive voltage is applied to the gap. Therefore, a large quantity of electrons can be emitted through application of low drive voltage.

The electron emitter having the aforementioned configuration may comprise a substrate which is provided on the reverse surface side of the emitter section and which supports the emitter section, and the emitter section may be bonded onto the front surface of the substrate.

In the electron emitter having the aforementioned configuration, the second electrode may be bonded onto the front surface of the substrate, and the emitter section may be bonded onto the second electrode. In this configuration, the second electrode is bonded onto the front surface of the substrate; the emitter section is bonded onto the second electrode; and the first electrode is provided on the front surface side of the emitter section. With this configuration, the mounting density of two-dimensionally arrayed electron emitters can be increased. Therefore, particularly when the electron emitter is applied to an FED, the resolution of the FED can be enhanced. In this configuration, the dielectric layer constituting the emitter section is provided between the first electrode and the second electrode. Therefore, unlike the case where both the electrodes are provided on the front surface side of the emitter section, even when relatively high drive voltage is applied to these electrodes, occurrence of creeping discharge along the front surface is suppressed.

In the electron emitter having the aforementioned configuration, preferably, the emitter section is formed so as to have a thickness of 1 to 300 μm.

When the thickness of the emitter section is less than 1 μm, the number of defects increases in the dielectric layer constituting the emitter section, and the dielectric layer is insufficiently densified. Therefore, the electric field intensity of defects in the interior of the dielectric layer, which do not participate in electron emission, becomes higher than that of electron emission regions (i.e., regions of the dielectric layer constituting the emitter section, the region participating in electron emission). In this case, satisfactory electron emission characteristics fail to be obtained at the electron emission regions. Meanwhile, in the case where the emitter section is sandwiched between the first electrode and the second electrode, the distance between these electrodes becomes excessively small, and thus dielectric breakdown may occur through application of drive voltage.

In contrast, when the thickness of the emitter section exceeds 300 μm, a large amount of stress is generated in the emitter section through application of drive voltage. When such a large amount of stress is generated, in order to properly support the emitter section, the thickness of the aforementioned substrate must be further increased. However, in such a configuration, difficulty is encountered in miniaturizing and thinning the electron emitter. In the case where the emitter section is sandwiched between the first electrode and the second electrode, high drive voltage must be applied for attaining an electric field intensity required for electron emission from the emitter. In this case, the electron emitter requires, for example, a drive IC for high-voltage use, leading to an increase in production cost of the emitter.

The thickness of the emitter section is more preferably 5 to 100 μm, from the viewpoints of densification of the structure of the dielectric layer, prevention of dielectric breakdown, miniaturization and thinning of the electron emitter, reduction of drive voltage, enhancement of production yield, and attainment of reliable electron emission performance.

Preferably, the electron emitter of the present invention is configured such that it can be operated as follows: in the first stage, drive voltage is applied such that the first electrode becomes lower in electric potential than the second electrode, whereby electrons are emitted (supplied) from the first electrode toward the front surface of the emitter section; i.e., electrons are accumulated on the front surface of the emitter section (the front surface is electrically charged); and in the second stage, drive voltage is applied such that the first electrode becomes higher in electric potential than the second electrode, whereby the polarization of the emitter section is inverted, resulting in emission of the electrons accumulated on the front surface of the emitter section. Such a configuration allows relatively easy control of the quantity of the charge on the front surface of the emitter section in the first stage, so that high electron emission quantity can be reliably attained with high controllability.

Particularly preferably, an opening is formed in the first electrode. With this configuration, a portion of the front surface of the emitter section corresponding to the opening is exposed to the exterior of the electron emitter (in an electron emission direction). In this configuration, both a peripheral edge portion and an inward portion of the first electrode as viewed in plane can constitute the aforementioned peripheral portion of the first electrode, below which the aforementioned gap is formed. Therefore, the area of the aforementioned electron emission regions is increased, and electron emission quantity is increased. Meanwhile, the opening can serve as a gate electrode or a focusing electron lens with respect to electrons emitted from the front surface of the emitter section, and thus rectilinearity of the emitted electrons can be enhanced. Therefore, when a plurality of electron emitters are arrayed on a flat plane, crosstalk between adjacent electron emitters is reduced. Particularly when the electron emitter is applied to an FED, the resolution of the FED is enhanced.

BRIEF DESCRIPTION OF THE DRAWINGS

Various other objects, features, and many of the attendant advantages of the present invention will be readily appreciated as the same becomes better understood with reference to the following detailed description of the preferred embodiments when considered in connection with the accompanying drawings, in which.

DETAILED DESCRIPTION OF THE INVENTION

A preferred embodiment of the electron emitter of the present invention will next be described with reference to tables and, as needed, the drawings.

<General Description of the Structure of an FED Including an Electron Emitter>

Figure 1:
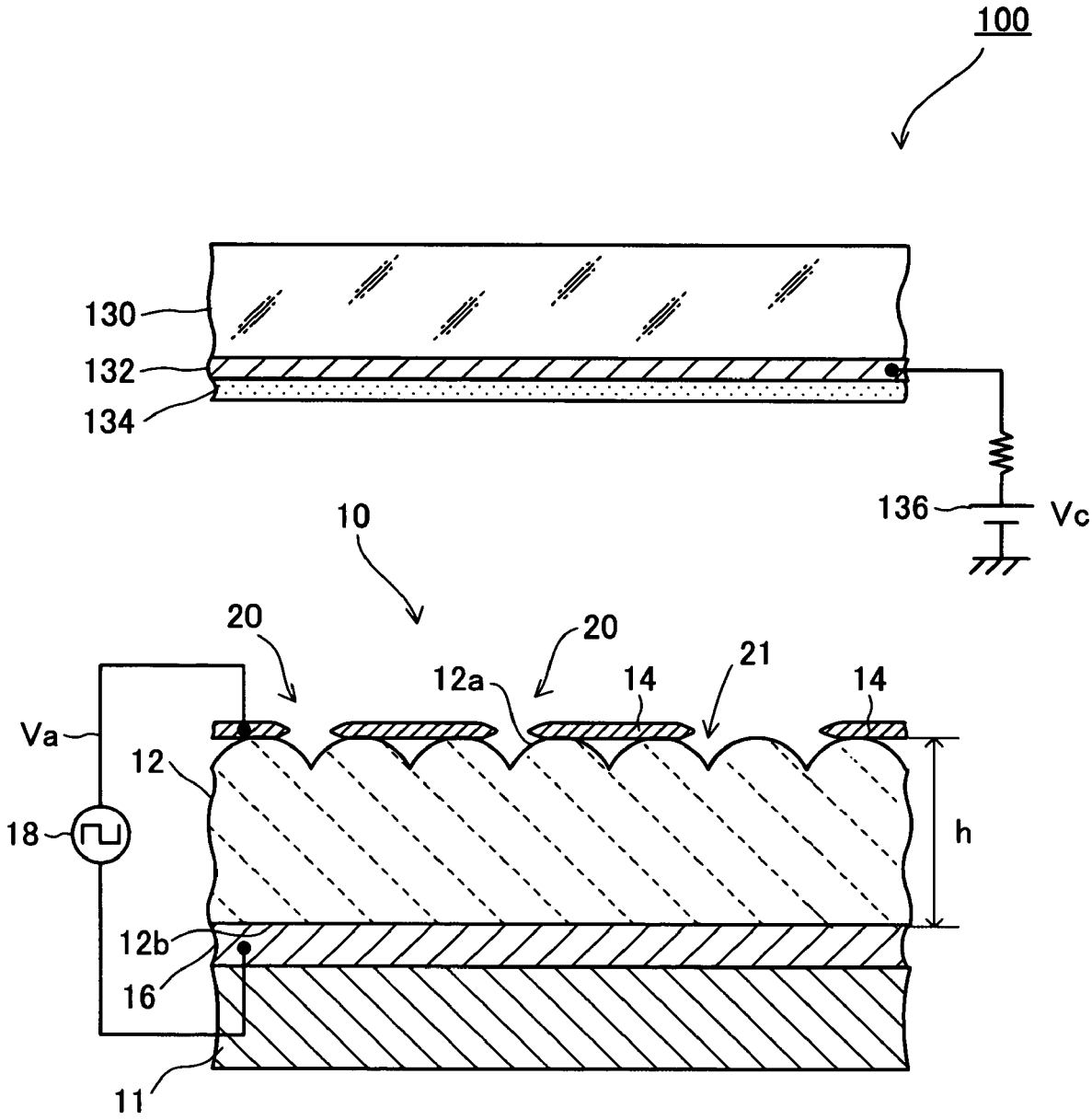
FIG. 1 is a fragmentary, cross-sectional view showing an electron emitter according to an embodiment of the present invention.

FIG. 1 is a partial cross-sectional view schematically showing a display (FED) 100 including an electron emitter 10 according to the present embodiment. The display 100 includes the electron emitter 10, a transparent plate 130, a collector electrode 132, a phosphor layer 134, and a bias voltage source 136.

The transparent plate 130, which is provided above the electron emitter 10, is formed of a glass plate or an acrylic plate. The collector electrode 132, which is provided on the lower surface of the transparent plate 130 (i.e., the surface facing the electron emitter 10), is formed of a transparent electrode such as an ITO (indium tin oxide) thin film. The phosphor layer 134 is formed on the lower surface of the collector electrode 132 (i.e., the surface facing the electron emitter 10). The space between the electron emitter 10 and the phosphor layer 134 is a reduced-pressure atmosphere having a predetermined vacuum level of, for example, $10^2$ to $10^{-6}$ Pa (more preferably $10^{-3}$ to $10^{-5}$ Pa). The bias voltage source 136 is connected to the collector electrode 132 via a predetermined resistor so that a collector voltage Vc can be applied to the collector electrode 132.

The display 100 is configured such that electrons are emitted from the electron emitter 10 through an electric field generated through application of the collector voltage Vc, and the electrons fly toward the collector electrode 132 and collide with the phosphor layer 134, whereby light is emitted from predetermined pixel positions.

<General Description of the Structure of the Electron Emitter>

The electron emitter 10 includes a substrate 11, an emitter section 12, a first electrode 14, a second electrode 16, and a pulse generator 18.

The substrate 11, which supports the emitter section 12, the first electrode 14, and the second electrode 16, is formed of a glass or ceramic plate material.

The emitter section 12 is formed of a thin layer of a polycrystalline dielectric material. The thickness h of the emitter section 12 is preferably 1 to 300 μm, more preferably 5 to 100 μm. The dielectric material constituting the emitter section 12 is formed of a material having high mechanical quality factor (Qm). Specifically, the dielectric material has a Qm higher than that of a so-called low-Qm material (a material having a Qm of 100 or less). The Qm of the dielectric material is preferably 300 or more, more preferably 500 or more. As shown in FIG. 1, microscopic concavities and convexities due to, for example, crystal grain boundaries are formed on a front surface 12*a* of the emitter section 12. The emitter section 12 of the electron emitter according to the present embodiment is formed such that the surface roughness Ra (centerline surface roughness, unit: μm) of the front surface 12*a* attributed to the concavities and convexities is 0.05 or more and 3 or less.

The first electrode 14 is formed on the front surface 12*a* of the emitter section 12. The first electrode 14 is formed of an electrically conductive material. Specific examples of the electrically conductive material include metallic film, metallic particles, electrically conductive non-metallic film (e.g., carbon film or electrically conductive non-metallic oxide film), and electrically conductive non-metallic particles (e.g., carbon particles or electrically conductive oxide particles). The aforementioned metallic film or metallic particles are preferably formed of platinum, gold, silver, iridium, palladium, rhodium, molybdenum, tungsten, or an alloy thereof. The aforementioned electrically conductive non-metallic film or electrically conductive non-metallic particles are preferably formed of graphite, ITO (indium tin oxide), or LSCO (lanthanum strontium copper oxide). When the first electrode 14 is formed of metallic particles or electrically conductive non-metallic particles, preferably, the particles assume in a scale-like, plate-like, foil-like, acicular, rod-like, or coil-like form.

The first electrode 14 is formed on the front surface 12*a* of the emitter section 12 through coating, vapor deposition, or a similar technique, so as to attain a thickness of 0.1 to 20 μm. The first electrode 14 may be formed directly on the front surface 12*a* of the emitter section 12, or may be formed indirectly via a predetermined coating layer.

The second electrode 16 is provided so as to be in contact with a reverse surface 12*b* of the emitter section 12. The second electrode 16 is formed of a metallic film so as to attain a thickness of preferably 20 μm or less (more preferably 5 μm or less). As shown in FIG. 1, the second electrode 16 is bonded onto the front surface of the substrate 11 in a manner similar to that of the aforementioned first electrode 14. As shown in FIG. 1, the emitter section 12 is bonded onto the front surface of the second electrode 16. As used herein, the term "bonded" refers to the case where a component is joined directly and closely to another component without employment of an organic or inorganic adhesive.

The first electrode 14 and the second electrode 16 are connected to the pulse generator 18 for applying a drive voltage Va to these electrodes.

In the configuration according to the present embodiment, first electrodes 14 are two-dimensionally arrayed with respect to the single-layer substrate 11, the emitter section 12, and the second electrode 16, whereby numerous electron emitters 10 are two-dimensionally formed. Notably, FIG. 1 shows, on its left side, a portion of one of the numerous electron emitters 10 which are two-dimensionally arrayed and formed. FIG. 1 also shows, on its extreme right, an end portion of the first electrode 14 of an electron emitter 10 adjacent to the emitter 10 of FIG. 1.

The first electrode 14 has a plurality of openings 20. The openings 20 are formed such that the front surface 12*a* of the emitter section 12 is exposed to the medium surrounding the electron emitter 10 (i.e., the aforementioned vacuum atmosphere; the same shall apply hereinafter). The front surface 12*a* of the emitter section 12 is exposed to the aforementioned medium also at peripheral edge portions 21 of the first electrode 14.

As described below in detail, the electron emitter 10 according to the present embodiment is configured such that electrons supplied from the first electrode 14 are accumulated on the front surface 12*a* of the emitter section 12 corresponding to the openings 20 and the peripheral edge portions 21, and the thus-accumulated electrons are emitted toward the exterior of the electron emitter 10 (i.e., toward the phosphor layer 134).

<Detailed Description of the Structure of the Electron Emitter>

Figure 2:
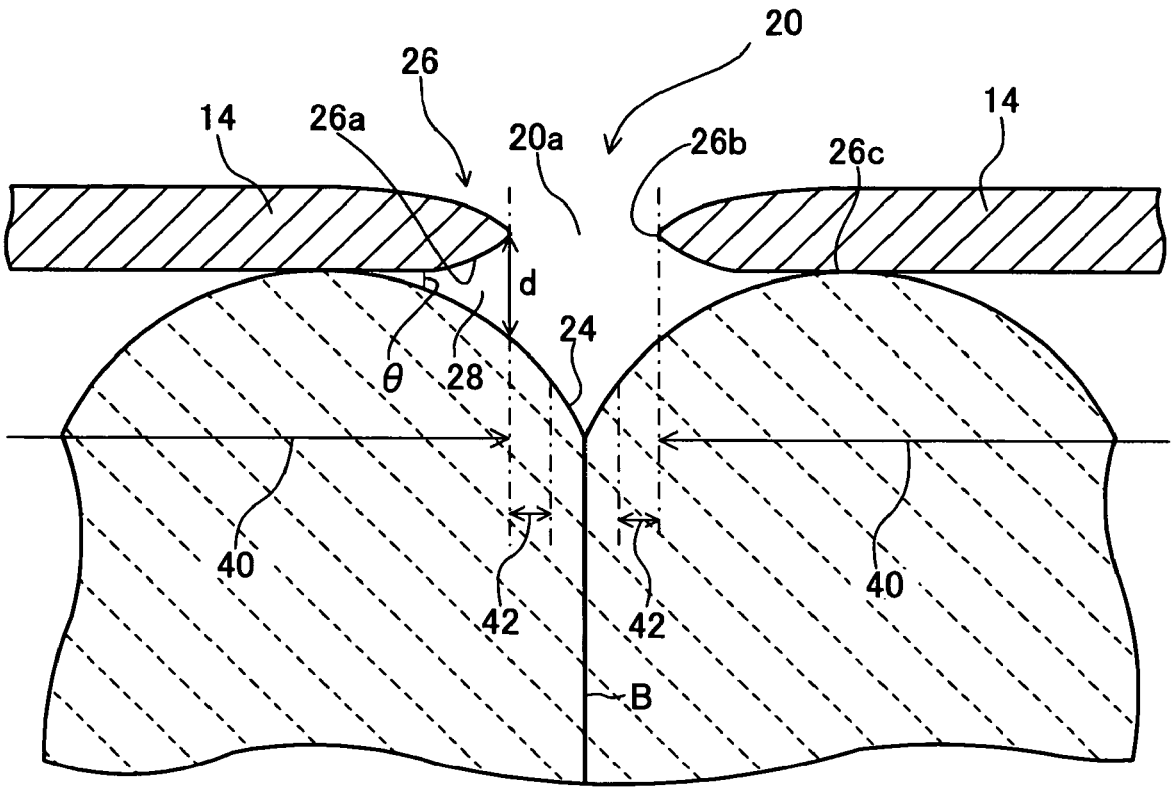
FIG. 2 is an enlarged cross-sectional view showing essential portions of the electron emitter.

FIG. 2 is an enlarged cross-sectional view showing essential portions of the electron emitter 10 of FIG. 1.

As described above, microscopic concavities 24 attributed to, for example, crystal grain boundaries (see reference letter B of FIG. 2) are formed on the front surface 12*a* of the emitter section 12. The openings 20 of the first electrode 14 are formed in regions corresponding to the concavities 24. In the case shown in FIG. 2 (or FIG. 1), the concavities 24 and the openings 20 are formed in one-to-one correspondence. However, in some cases, a single opening 20 may be formed for a plurality of concavities 24. Alternatively, a plurality of openings 20 may be formed for a single concavity 24.

In the first electrode 14, a peripheral portion 26, which is a portion in the vicinity of the opening 20, is formed so as to be apart from the surface of the concavity 24 (the front surface 12*a* of the emitter section 12) and to overhang in the aforementioned medium. In other words, a gap 28 is formed between the surface of the concavity 24 (the front surface 12*a* of the emitter section 12) and a surface 26*a* of the peripheral portion 26 of the first electrode 14, the surface 26*a* facing the emitter section 12. The cross section of the peripheral portion 26 of the first electrode 14 (i.e., a portion in the vicinity of the opening 20) assumes an overhanging form. Accordingly, in the subsequent description, the "peripheral portion 26" will be called an "overhanging portion 26." The "surface 26*a* of the peripheral portion 26 that faces the emitter section 12" will be called a "lower surface 26*a* of the overhanging portion 26."

In the electron emitter 10, the surface in the vicinity of the vertexes of convexities formed on the front surface 12*a* of the emitter section 12, and the lower surface 26*a* of the overhanging portion 26 form a maximum angle θ that satisfies the following relation: $1° \leqq \theta \leqq 60°$.

In the electron emitter 10, the emitter section 12 and the first electrode 14 are formed such that the maximum gap d measured vertically between the front surface 12*a* of the emitter section 12 and the lower surface 26*a* of the overhanging portion 26 is regulated so as to satisfy the following relation: $0\ \mu m \leqq d \leqq 10\ \mu m$.

Triple junctions 26*c* are formed at contact sites among the front surface 12*a* of the emitter section 12, the first electrode 14, and the aforementioned medium (vacuum) surrounding the electron emitter 10. The triple junctions 26*c* are sites (electric field concentration points) at which lines of electric force concentrate (where electric field concentration occurs) when a drive voltage Va is applied between the first electrode 14 and the second electrode 16. As used herein, the expression "site at which lines of electric force concentrate" refers to a site at which lines of electric force that are generated from the second electrode 16 at even intervals concentrate, when the lines of electric force are drawn under the assumption that the first electrode 14, the emitter section 12, and the second electrode 16 are flat plates each having a cross section extending infinitely. The state of the concentration of lines of electric force (i.e., the state of electric field concentration) can be readily observed through simulation by means of numerical analysis employing the finite-element method.

Further, in the present embodiment, tip ends 26*b* of the overhanging portions 26, which form inner edges of the openings 20, have such a shape as to serve as the aforementioned electric field concentration points. Specifically, the overhanging portion 26 has such a cross-sectional shape as to be acutely pointed toward the tip end 26*b* of the portion 26; i.e., the thickness gradually decreases.

The tip ends 26*b* of the overhanging portions 26 and the aforementioned triple junctions 26*c*, which constitute the aforementioned electric field concentration points, are also formed at the peripheral edge portions 21 shown in FIG. 1.

Through holes 20*a* defined by the inner edges of the openings 20 may be formed to assume a variety of shapes as viewed in plane, including a circular shape, an elliptical shape, a polygonal shape, and an irregular shape. The through holes 20*a* are formed such that, when the through holes 20*a* as viewed in plane are approximated to circles having areas identical to those of the through holes 20*a* as viewed in plane, the average diameter of the circles (hereinafter may be referred to as "the average diameter of the through holes 20*a*") becomes 0.1 μm or more and 20 μm or less. The reason for this is described below.

As shown in FIG. 2, regions of the emitter section 12 where polarization is inverted or changes in accordance with application of the drive voltage Va are regions (first regions) 40 located just under the first electrode 14, and regions (second regions) 42 corresponding to regions of the through holes 20*a* that extend from the tip ends 26*b* of the overhanging portions 26 toward the centers of the through holes 20*a*. The second regions 42 form primary regions of the electron emission regions of the front surface 12*a* of the emitter section 12 which contribute to electron emission. The range of the second regions 42 varies depending on the level of the drive voltage Va and the degree of electric field concentration in the aforementioned electric field concentration points.

Thus, when the average diameter of the through holes 20*a* falls within the above-described range (i.e., 0.1 μm or more and 20 μm or less), a sufficient quantity of electrons are efficiently emitted at the first regions 40 and the second regions 42.

When the average diameter of the through holes 20*a* is less than 0.1 μm, the area of the second regions 42 decreases. Therefore, a decrease in the area of the second regions 42 results in reduction of the quantity of electrons to be emitted. In contrast, when the average diameter of the through holes 20*a* exceeds 20 μm, the ratio of the second regions 42 to regions of the front surface 12*a* of the emitter section 12 exposed through the openings 20 (occupancy of the exposed regions) decreases, resulting in reduction of electron emission efficiency.

Preferably, the openings 20 are formed such that the total of the areas of the openings 20 accounts for 5 to 80% of the entire surface area of the front surface 12*a* of the emitter section 12 capable of contributing to electron emission. As used herein, "the entire surface area of the front surface 12*a* of the emitter section 12 capable of contributing to electron emission" corresponds to the sum of the area of the surface of the emitter section 12 exposed in the vicinity of the peripheral edge portions 21 (see FIG. 1) of the first electrode 14 (the area of the front surface 12*a* of the emitter section 12 directly below the peripheral portions of the first electrode 14; i.e., the area of the second regions 42 shown in FIG. 2) and the total of the areas of the openings 20.

<Equivalent Circuit of Electron Emitter>

Figure 3:
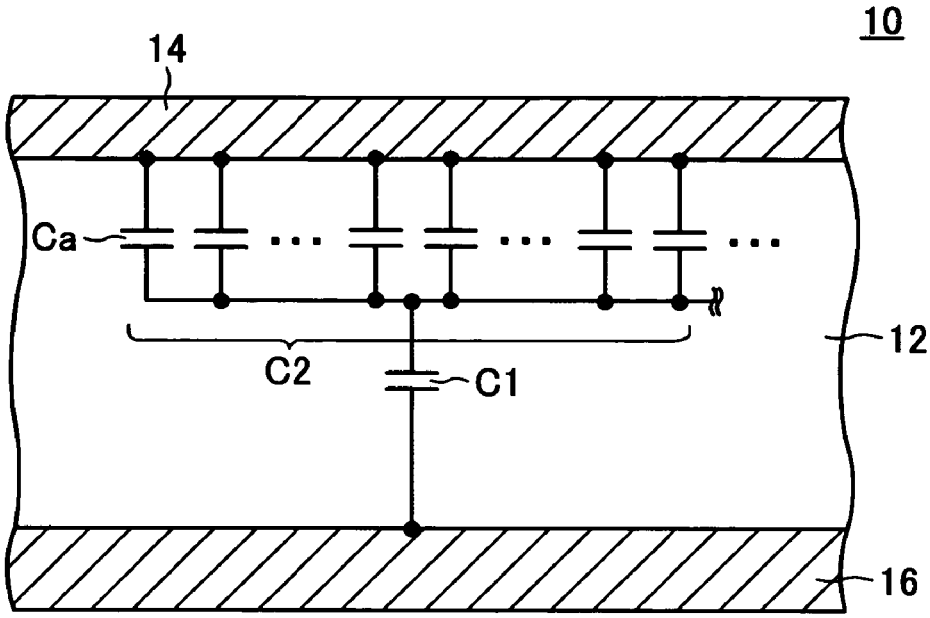
FIG. 3 is an equivalent circuit diagram for explaining influence of a gap between a first electrode and an emitter section on an electric field between the first electrode and a second electrode.

As shown in FIG. 3, in terms of electrical circuit, the structure of the electron emitter 10 according to the present embodiment can be approximated to a configuration in which a capacitor C1 associated with the emitter section 12 is connected in series to a capacitor C2 formed of an aggregate of a plurality of capacitors Ca associated with the aforementioned gaps 28, the capacitors C1 and C2 being formed between the first electrode 14 and the second electrode 16. In the capacitor C2, the capacitors Ca associated with the gaps 28 (see FIG. 2) are connected in parallel.

However, the equivalent circuit, in which the capacitor C2 formed of the aforementioned aggregate of the capacitors Ca is connected in series to the capacitor C1 associated with the emitter section 12, is not practical. Therefore, a practical equivalent circuit is formed such that a portion of the capacitor C1 associated with the emitter section 12 is connected in series to the capacitor C2 formed of the capacitor aggregate in accordance with the number and state of the openings 20 formed in the first electrode 14 as shown in FIGS. 1 and 2.

Figure 4:
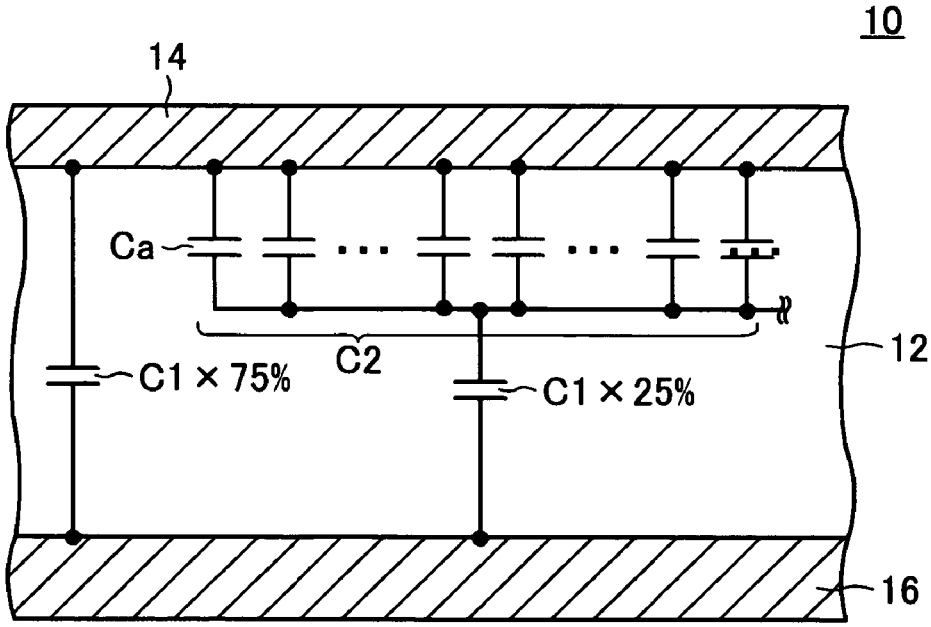
FIG. 4 is an equivalent circuit diagram for explaining influence of the gap between the first electrode and the emitter section on the electric field between the first electrode and the second electrode.

Capacitance will now be calculated under the assumption that, as shown in FIG. 4, for example, 25% of the capacitor C1 associated with the emitter section 12 is connected in series to the capacitor C2 formed of the aggregate.

Since the gaps 28 are in a vacuum, their relative dielectric constant thereof is 1. Conditions of the calculation are as follows: the maximum distance d of the gaps 28 is 0.1 μm; the area S of a region corresponding to a single gap 28 is 1 μm×1 μm; the number of the gaps 28 is 10,000; the dielectric constant of the emitter section 12 is 2,000; the thickness of the emitter section 12 is 20 μm; and the facing area between the first electrode 14 and the second electrode 16 is 200 μm×200 μm.

Under the above-described conditions, the capacitance of the capacitor C2 formed of the aggregate is 0.885 pF, and the capacitance of the capacitor C1 associated with the emitter section 12 is 35.4 pF. Since 25% of the capacitor C1 associated with the emitter section 12 is connected in series to the capacitor C2 formed of the aggregate, the capacitance of the portion of series connection (capacitance including that of the capacitor C2 formed of the aggregate) is 0.805 pF, and the capacitance of the remaining portion is 26.6 pF.

Of the capacitor C1 associated with the emitter section 12, the portion connected in series to the capacitor C2 formed of the aggregate is connected in parallel to the remaining portion of the capacitor C1. Therefore, the overall capacitance between the first electrode 14 and the second electrode 16 is 27.5 pF, which is 78% of the capacitance of the capacitor C1 associated with the emitter section 12 (i.e., 35.4 pF). That is, the overall capacitance is lower than the capacitance of the capacitor C1 associated with the emitter section 12.

As described above, the capacitance of the capacitors Ca associated with the gaps 28, or the overall capacitance of the capacitor C2 formed of the aggregate of the capacitors Ca is considerably lower than that of the capacitor C1 (associated with the emitter section 12) which is connected in series to the capacitor C2. Therefore, the electron emitter 10 is configured such that when the drive voltage Va is applied to the series circuit of the capacitors Ca (C2) and C1, most of the voltage Va is applied to the capacitors Ca (C2), whose capacitance is lower than that of the capacitor C1. In other words, the electron emitter 10 is configured such that most of the drive voltage Va can be applied to the gaps 28 (see FIG. 2).

<Electron Emission Principle of Electron Emitter>

Figure 5:
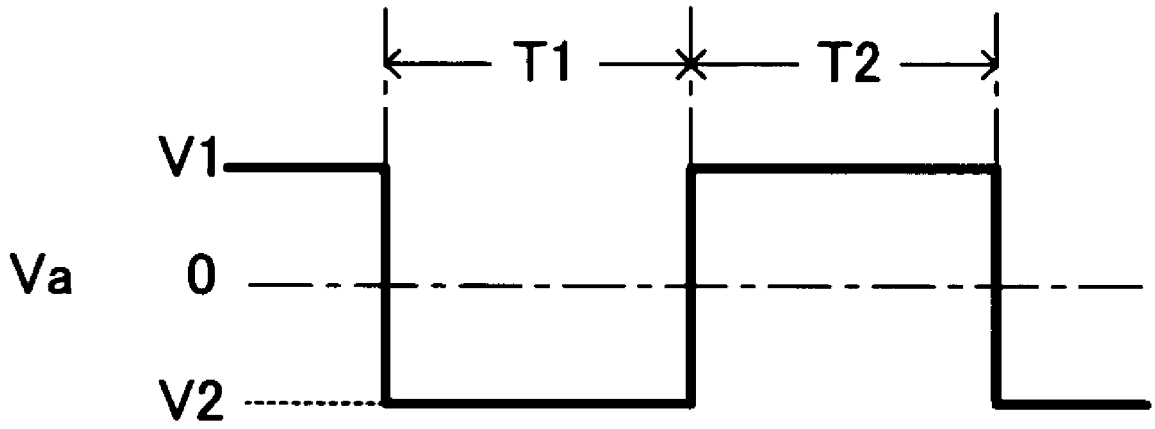
FIG. 5 is a diagram showing the waveform of a drive voltage to be applied to the electron emitter.

Next the principle of electron emission of the electron emitter 10 will be described with reference to FIGS. 5 to 7C. FIG. 5 is a diagram showing the waveform of a drive voltage Va. FIGS. 6A to 6C and FIGS. 7A to 7C are schematic representations for explaining operation of the electron emitter 10.

In the present embodiment, as shown in FIG. 5, the drive voltage Va to be applied between the first electrode 14 and the second electrode 16 is an alternating voltage of rectangular waveform (reference voltage (voltage corresponding to the center of the wave): 0 [V], amplitude: (V1+V2) [V], period: (T1+T2) [s]). In the drive voltage Va, during time T1 corresponding to the first stage, the electric potential of the first electrode 14 is V2 (negative voltage), which is lower than the electric potential of the second electrode 16; and during time T2 corresponding to the second stage, the electric potential of the first electrode 14 is V1 (positive voltage), which is higher than the electric potential of the second electrode 16.

Figure 6A:
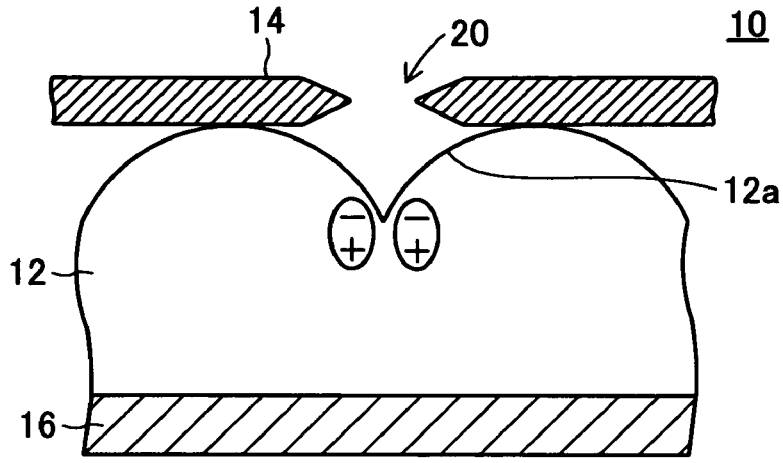
FIGS. 6A to 6C are schematic representations for explaining operation of the electron emitter.

Operation of the electron emitter 10 will next be described under the assumption that the emitter section 12 is polarized unidirectionally in the initial state (specifically, as shown in FIG. 6A, the emitter section 12 is initialized such that the negative poles of dipoles face toward the front surface 12*a* of the emitter section 12).

Firstly, in the initial state, in which the voltage between the first electrode 14 and the second electrode 16 is the reference voltage, as shown in FIG. 6A, the negative poles of dipoles face toward the front surface 12*a* of the emitter section 12, so that virtually no electrons are accumulated on the front surface 12*a* of the emitter section 12.

Figure 6B:
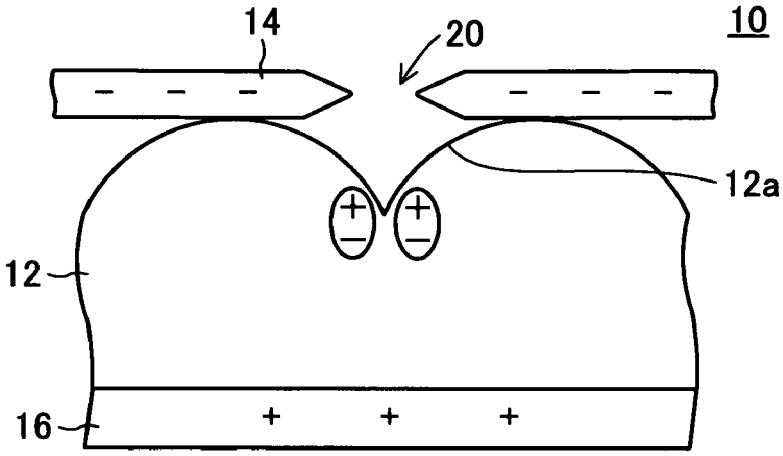
Figure 6C:
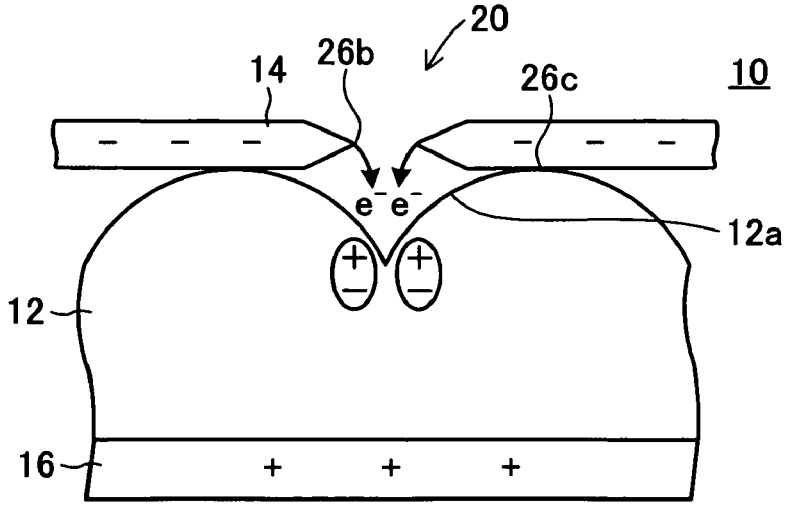

Subsequently, when the negative voltage V2 is applied, as shown in FIG. 6B, polarization is inverted. This inversion of polarization causes electric field concentration to occur at the tip end 26*b* and the triple junction 26*c*, which are the aforementioned electric field concentration points, so that electrons are emitted (supplied) from the electric field concentration points of the first electrode 14 toward the front surface 12*a* of the emitter section 12. For example, as shown in FIG. 6C, electrons are accumulated in a region of the front surface 12*a* exposed through the opening 20 and in a region in the vicinity of the overhanging portion 26. In other words, the front surface 12*a* is electrically charged. The charging of the front surface 12*a* can be continued until a predetermined saturated condition, which depends on the surface resistance of the emitter section 12, is attained. The quantity of the charge can be controlled on the basis of, for example, drive voltage waveform. Thus, the first electrode 14 (in particular, the aforementioned electric field concentration points) functions as an electron supply source for the emitter section 12 (front surface 12*a*).

Figure 7A:
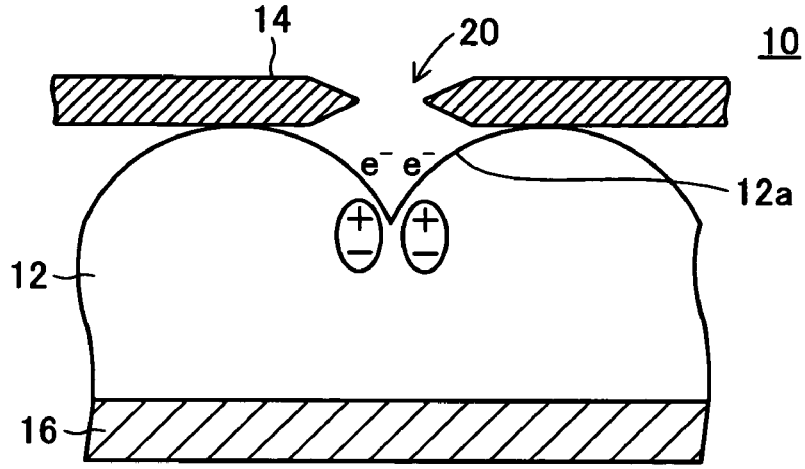
FIGS. 7A to 7C are schematic representations for explaining operation of the electron emitter.
Figure 7B:
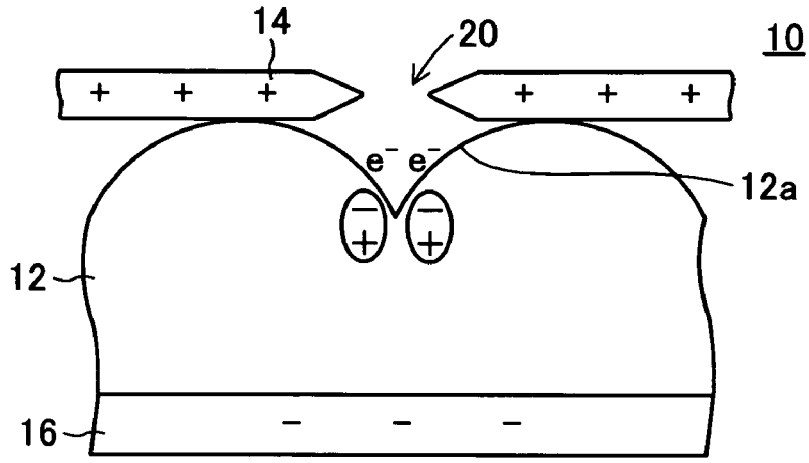
Figure 7C:
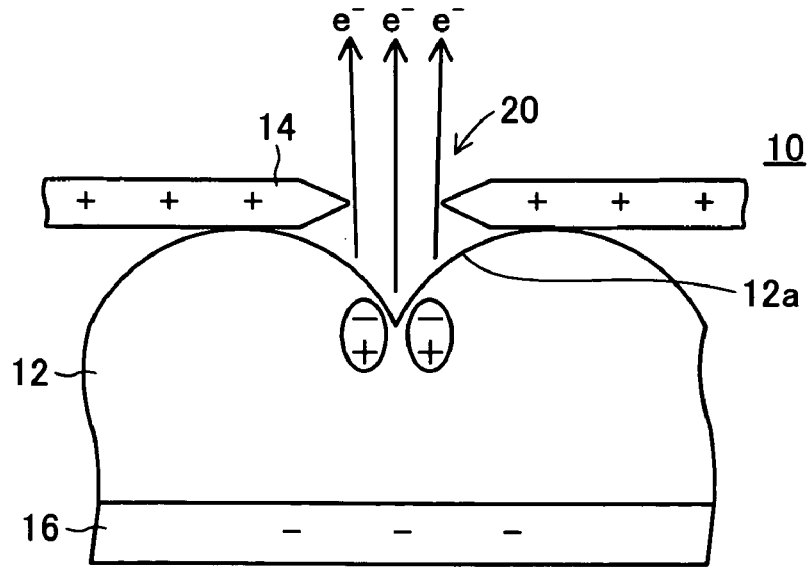

Subsequently, when the drive voltage Va is changed from the negative voltage V2 to the reference voltage as shown, in FIG. 7A, and then to the positive voltage V1, polarization is re-inverted (see FIG. 7B). As a result, electrostatic repulsion between the accumulated electrons and the negative poles of dipoles causes the electrons to be emitted from the front surface 12*a* toward the exterior of the electron emitter 10 through the through hole 20*a* (see FIG. 7C).

In a manner similar to that described above, electrons are emitted from the peripheral edge portions 21 (see FIG. 1) of the first electrode 14 at which the openings 20 are not present.

<Specific Example of Electron Emitter Production Method>

Next will be described an example of a production method for the electron emitter 10 according to the present embodiment having the aforementioned configuration (see, for example, FIG. 1) with reference to reference numerals of FIGS. 1 and 2 showing the configuration of the electron emitter 10.

Firstly, on a substrate 11 formed of $Y_2O_3$-stabilized $ZrO_2$, a Pt-containing metal paste layer having predetermined dimensions and shape is formed through screen printing. The thus-formed metal paste layer is heated at about 1,000 to about 1,400° C., to thereby form a Pt-containing second electrode 16 (thickness: 3 μm) bonded and integrated with the substrate 11.

Subsequently, a dielectric paste layer containing a dielectric material employed in the present invention is formed on the second electrode 16 through screen printing so as to attain a thickness of 40 μm. Specifically, the dielectric paste layer can be formed as follows.

Examples of raw materials for the dielectric material which may be employed include oxides of Pb, Mg, Nb, Zr, Ti, Ni, La, Sr, Mn, Ce, etc. (e.g., PbO, $Pb_3O_4$, MgO, $Nb_2O_5$, $TiO_2$, $ZrO_2$, NiO, $La_2O_3$, SrO, $MnO_2$, and $CeO_2$ etc.); carbonates of these elements (e.g., $MgCO_3$ and $SrCO_3$ etc.); compounds containing two or more species of these elements (e.g., $MgNb_2O$ etc.); these metallic elements per se; and alloys of these elements. These raw materials may be employed singly or in combination of two or more species.

No particular limitation is imposed on the preparation method for the dielectric material employed in the present invention, and the dielectric material may be prepared through, for example, the following procedure.

Firstly, the aforementioned raw materials are mixed together such that the corresponding elements have predetermined contents. Subsequently, the resultant raw material mixture is heated at 750 to 1,300° C., to thereby yield a dielectric material employed in the present invention. When the dielectric material obtained through heating is subjected to X-ray diffractometry, the ratio of the intensity of the strongest diffraction line of a phase other than a perovskite phase (e.g., a pyrochlore phase) to that of the strongest diffraction line of the perovskite phase is preferably 5% or less, more preferably 2% or less. Finally, the dielectric material obtained through heating is milled by means of, for example, a ball mill, to thereby prepare dielectric material powder particles having a predetermined particle size (e.g., an average particle size of 0.1 to 1 μm as measured through laser diffractometry).

The thus-prepared dielectric material powder particles are dispersed in a mixture of a predetermined binder and solvent, to thereby prepare a dielectric paste. By use of the thus-prepared paste, a dielectric paste layer is formed on the second electrode 16 through screen printing as described above.

The thus-formed dielectric paste layer is thermally treated, thereby evaporating the binder and solvent, and densifying the dielectric layer. Through this procedure, an emitter section 12 is formed.

Subsequently, a first electrode 14 is formed on the thus-formed emitter section 12 through a thick film formation process (e.g., screen printing employed for formation of the aforementioned second electrode 16) or a thin film formation process (e.g., vapor deposition). When, for example, the first electrode 14 is to be formed by use of an oxide electrode such as SRO ($SrRuO_3$), LSCO ($(La,Sr)CoO_3$), or LNO ($LaNiO_3$), the following procedure can be performed.

Firstly, raw material (e.g., $SrCO_3$) is wet-mixed by means of a ball mill employing zirconia balls. The resultant mixture is heated at about 1,000° C. The powder obtained through heating is mixed with PbO powder serving as an additive, and the resultant mixture is heated, thereby yielding a sputtering target. A first electrode 14 is formed through thin film formation by means of a sputtering apparatus employing the sputtering target.

Thus, the electron emitter 10 of dielectric film type is produced.

EXAMPLES

As described below, in Examples and Comparative Examples, electron emitters were produced through the aforementioned production method, and the thus-produced emitters were evaluated on the basis of the below-described "electron emission efficiency."

As shown in FIG. 1, when Va represents drive voltage applied between the first electrode 14 and the second electrode 16; Vc represents electron accelerating voltage (collector voltage) of the bias voltage source 136 for generating an external electric field which causes electrons emitted from the electron emitter 10 to fly in a predetermined direction; $i_c$ represents current due to the electrons emitted from the electron emitter 10 (i.e., current which flows between the bias voltage source 136 and the collector electrode 132); and P represents drive power for the electron emitter 10, electron emission efficiency η is represented by the following formula:

$$\eta = Vc \times i_c / (P + Vc \times i_c)$$

Figure 8:
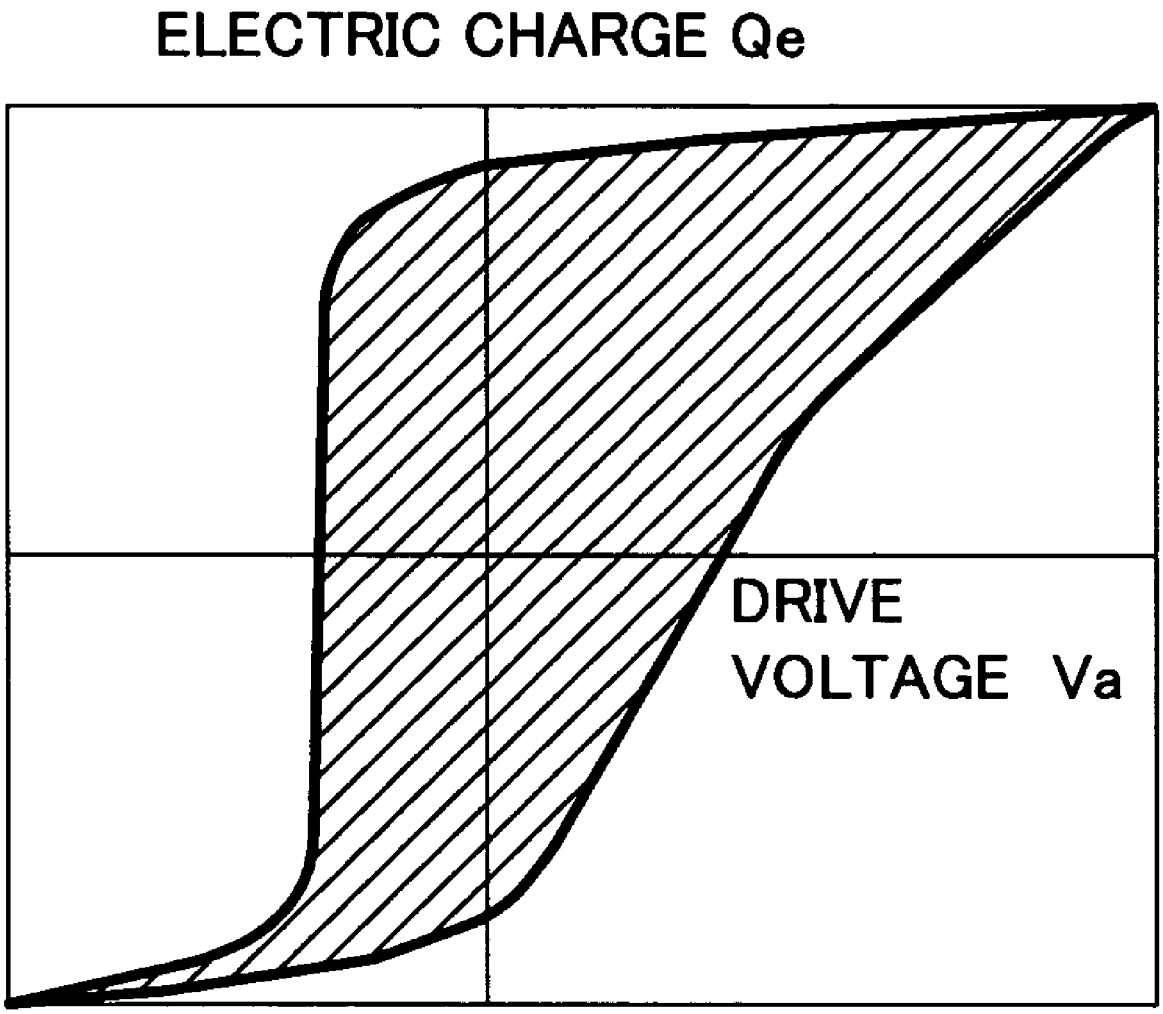
FIG. 8 shows the Q-V hysteresis of a dielectric material.

(wherein drive power P=[hysteresis loss of electron emitter: P1]+[resistance loss in drive circuit: P2]). P1 is the area enclosed by the Q-V hysteresis loop shown in FIG. 8 (i.e., the area of the shaded portion shown in FIG. 8). P2, which varies with the method for driving the electron emitter, is represented by the following inequality: 0≦P2≦(drive voltage Va×electric charge Qe)−(the area enclosed by the Q-V hysteresis loop)=(the area of a portion outside the shaded portion shown in FIG. 8). In this inequality, 0 on the left side corresponds to the case where the electron emitter is driven such that the drive power follows the Q-V hysteresis.

Example 1

The first electrode 14 was formed by applying Pt/LSCO (Pt resinate containing 1 wt. % LSCO) onto the front surface 12*a* of the emitter section 12 through screen printing, followed by heating. The emitter section 12 was formed of a dielectric material containing 35.5PMN-39.5PT-25PZ as a primary component and containing $MnO_2$ in an amount of 0.6 wt. %. The Qm of the dielectric material was 1,074.

Comparative Example 1

In Comparative Example 1-1, there was employed a dielectric material having a Qm of 30 (dielectric material containing, as a primary component, 37.5PMN-37.5PT-25PZ in which the amount of Pb substituted by Sr is 6 mol % and the amount of Pb substituted by La is 0.7 mol %, and containing $CeO_2$ in an amount of 0.2 wt. %). In Comparative Example 1-2, a dielectric material having a Qm of 88 was employed. Table 1 shows the results of evaluation of the electron emitters of Example 1 and Comparative Example 1. The column "electron emission efficiency" of Table 1 shows values relative to 1 of the electron emitter of Comparative Example 1-1 (taken as 1). P2 was the aforementioned maximum value, and the drive voltage was 300 V/−70 V.

TABLE 1

| | Qm | Electron emission efficiency |
|---|---|---|
| Example 1 | 1074 | 1.73 |
| Comparative Example 1-1 | 30 | 1.00 |
| Comparative Example 1-2 | 88 | 0.96 |

Example 2

In Example 2, the first electrode 14 was formed by mixing organometallic compounds such that the proportions by weight of Pt/Au/Ir was 93.0/4.5/2.5, and by subjecting the resultant mixture to screen printing and heating. In Example 2-1, the emitter section 12 was formed of a dielectric material having a Qm of 1,074, which is the same as the dielectric material employed in Example 1. In Example 2-2, the emitter section 12 was formed of a dielectric material containing, as a primary component, 37.5PMN-25PT-37.5PZ in which the amount of Pb substituted by Sr is 8 mol %, and containing $MnO_2$ in an amount of 0.2 wt. %. The Qm of the dielectric material was 508.

Comparative Example 2

In Comparative Example 2-1, there was employed a dielectric material having a Qm of 30, which is the same as the dielectric material employed in Comparative Example 1-1 (i.e., dielectric material containing, as a primary component, 37.5PMN-37.5PT-25PZ in which the amount of Pb substituted by Sr is 6 mol % and the amount of Pb substituted by La is 0.7 mol %, and containing $CeO_2$ in an amount of 0.2 wt. %). In Comparative Example 2-2, a dielectric material having a Qm of 88 was employed. In Comparative Example 2-3, a dielectric material having a Qm of 95 was employed. Table 2 shows the results of evaluation of the electron emitters of Example 2 and Comparative Example 2. The column "electron emission efficiency" of Table 2 shows values relative to η of the electron emitter of Comparative Example 2-1 (taken as 1). P2 was the aforementioned maximum value, and the drive voltage was 200 V/−50 V.

TABLE 2

| | Qm | Electron emission efficiency |
|---|---|---|
| Example 2-1 | 1074 | 1.42 |
| Example 2-2 | 508 | 1.23 |
| Comparative Example 2-1 | 30 | 1.00 |
| Comparative Example 2-2 | 88 | 0.85 |
| Comparative Example 2-3 | 95 | 0.52 |

As is clear from the evaluation results, in the cases of Examples 1 and 2, in which Qm falls within the scope of the present invention, the electron emitters exhibit high electron emission efficiency; i.e., 1.2 times or more that of the electron emitter of Comparative Example 1-1 or 2-1. Even when P2 is 0, high electron emission efficiency is attained. Conceivably, improvement of electron emission efficiency, which is observed in Examples 1 and 2, is attributed to the mechanism described below (see FIG. 2).

In the electron emitter 10 of the present embodiment, as described above, in the first stage, electrons are supplied from the overhanging portion 26 of the first electrode 14 to the front surface 12*a* of the emitter section 12, and the electrons are accumulated on the front surface 12*a*. Subsequently, in the second stage, inversion of polarization occurs in the emitter section 12, and electrostatic repulsion causes the accumulated electrons to be emitted from the front surface 12*a* toward the exterior of the electron emitter through the through hole 20*a*.

When the dielectric material constituting the emitter section 12 has high Qm, the aforementioned inversion of polarization occurs at high speed. Therefore, accumulation of electrons on the front surface 12*a* of the emitter section 12, as well as emission of the accumulated electrons to the exterior of the electron emitter can occur at high speed. This reduces the probability that electrons flying in the medium surrounding the electron emitter 10 in the vicinity of the opening 20 are trapped by the first electrode 14. As a result, the quantity of electrons emitted from the electron emitter 10 increases.

The second region 42, which is not located directly below the first electrode 14, plays a central role in electron emission, but has an electric field intensity lower than that of the first region 40, which is located directly below the first electrode 14. Particularly, in the electron emitter 10 of the present embodiment, the overhanging portion 26 is formed on the first electrode 14, and the second region 42 is located on the concavity 24 provided below the overhanging portion 26, the concavity 24 being separated from the overhanging portion 26 by the gap 28. That is, a gap 28 as large as d (maximum dimension) is provided between the first electrode 14 and the surface of the concavity 24 (i.e., the front surface 12*a* of the emitter section 12). Therefore, conceivably, in the second region 42, inversion of polarization is more difficult to occur, as compared with in the first region 40. However, when the dielectric material constituting the emitter section 12 has high Qm, even in the second region 42, inversion of polarization can occur reliably at sufficiently high speed.

Accordingly, in the configuration of the present embodiment, the degree of electric field concentration increases by means of the emitter section 12 and the first electrode 14 having the overhanging portion 26. In addition, since the emitter section 12 is formed of the aforementioned high-Qm dielectric material, inversion of polarization occurs at high speed. Therefore, the quantity of electrons to be emitted can be increased, and electron emission efficiency can be improved.

As described above, according to the configuration of the present embodiment, electron emission characteristics of the electron emitter 10 (i.e., static dielectric-film element) can be improved on the basis of Qm, which is generally a dynamic characteristic parameter.

<Modifications>

The above-described embodiment and examples are merely typical embodiment and examples of the present invention which were considered best by the present inventors at the time when the present application was filed. Therefore, it should be understood that the present invention is not limited to the above-described embodiment and Examples, and various modifications of the invention may be made so long as the essentials of the present invention are not changed.

(i) The configuration of the electron emitter of the present invention is not limited to that of the electron emitter 10 described above in the embodiment. For example, both the first electrode 14 and the second electrode 16 may be formed on the front surface 12*a* of the electron emitter 12, although, in the aforementioned embodiment, the first electrode 14 and the second electrode 16 are respectively formed on the front surface 12*a* and the reverse surface 12*b* of the emitter section 12. Each of the first electrode 14, the emitter section 12, and the second electrode 16 may have a multi-layer structure.

(ii) The substrate 11 may be formed of a glass or metallic material in place of a ceramic material. No particular limitation is imposed on the type of the ceramic material to be employed. However, from the viewpoints of heat resistance, chemical stability, and insulating property, the substrate 11 is preferably formed of a ceramic material containing at least one species selected from the group consisting of stabilized zirconium oxide, aluminum oxide, magnesium oxide, mullite, aluminum nitride, silicon nitride, and glass. More preferably, the substrate 11 is formed of stabilized zirconium oxide, from the viewpoints of high mechanical strength and excellent toughness.

As used herein, the term "stabilized zirconium oxide" refers to zirconium oxide in which crystal phase transition is suppressed through addition of a stabilizer. The stabilized zirconium oxide encompasses partially stabilized zirconium oxide. Examples of the stabilized zirconium oxide include zirconium oxide containing a stabilizer (e.g., calcium oxide, magnesium oxide, yttrium oxide, scandium oxide, ytterbium oxide, cerium oxide, or an oxide of a rare earth metal) in an amount of 1 to 30 mol %. From the viewpoint of further enhancement of the mechanical strength of a vibration section, zirconium oxide containing yttrium oxide as a stabilizer is preferably employed. In this case, the yttrium oxide content is preferably 1.5 to 6 mol %, more preferably 2 to 4 mol %. Zirconium oxide containing, in addition to yttrium oxide, aluminum oxide in an amount of 0.1 to 5 mol % is more preferred.

The stabilized zirconium oxide may have, for example, a cubic-monoclinic mixed crystal phase, a tetragonal-monoclinic mixed crystal phase, or a cubic-tetragonal-monoclinic mixed crystal phase. From the viewpoints of strength, toughness, and durability, the stabilized zirconium oxide preferably has, as a primary crystal phase, a tetragonal crystal phase or a tetragonal-cubic mixed crystal phase.

(iii) The dielectric material constituting the emitter section 12 may be any dielectric material, so long as the material has a Qm falling within the aforementioned range. For example, the dielectric material to be employed may be a lead-containing piezoelectric/electrostrictive material described in the Examples, or a lead-free piezoelectric/electrostrictive material. Specific examples of the lead-free piezoelectric/electrostrictive material include lithium niobate ($LiNbO_3$), lithium tantalate ($LiTaO_3$), a solid solution of these compounds ($LiNb_{1-x}Ta_xO_3$), a compound formed of such a solid solution in which Li may be substituted by K or Na (general formula of the compound: $ABO_3$ [wherein A represents at least one species selected from among K, Na, and Li, and B represents Nb and/or Ta]), and lithium tetraborate ($Li_2B_4O_7$).

(iv) The dielectric material constituting the emitter section 12 may be prepared through a variety of methods in addition to the method described above in the embodiment. For example, the alkoxide method or the coprecipitation method may be employed. After the first electrode 14 or the second electrode 16 is formed, preferably, thermal treatment is carried out. Such thermal treatment is not necessarily performed. However, in order to bond and combine the second electrode 16 with the substrate 11, preferably, thermal treatment is carried out after formation of the second electrode 16 on the substrate 11 as described above in the embodiment.

(v) The first electrode 14 or the second electrode 16 may be formed of a metal, or an electrically conductive material other than electrically conductive particles. Examples of the metal which may be employed include at least one metal selected from the group consisting of platinum, palladium, rhodium, gold, silver, and an alloy thereof. Particularly, from the viewpoint that high heat resistance is required during thermal treatment of a piezoelectric/electrostrictive section, platinum or an alloy predominantly containing platinum is preferably employed. Alternatively, from the viewpoints of low cost and high heat resistance, a silver-palladium alloy is preferably employed.

(vi) The openings 20 of the first electrode 14 may assume a variety of shapes. Specifically, the cross-sectional shape of the overhanging portion 26 such that lines of electric force concentrate at the tip end 26*b* can be easily realized through employment of a cross-sectional shape such that the thickness of the first electrode 14 gradually decreases toward the tip end 26*b*; for example, a cross-sectional shape as shown in FIG. 2, in which the overhanging portion 26 has an acutely pointed portion at a central portion (in a thickness direction) of the first electrode 14, or a cross-sectional shape in which the overhanging portion 26 has an acutely pointed portion in the vicinity of the bottom surface of the first electrode 14. The aforementioned shape of the opening 20 may be attained by providing a projection having a sharp cross section to the inner wall of the opening 20, or by depositing electrically conductive fine particles onto the inner wall thereof. Alternatively, the aforementioned shape of the opening 20 may be attained by imparting a hyperboloidal profile (particularly a hyperboloidal profile such that the cross section of the opening 20 has a sharp upper end and a sharp lower end at the inner edge of the opening 20) to the inner wall of the opening 20.

(vii) Operationally or functionally described elements constituting means for achieving the objects of the present invention encompass, in addition to specific structures disclosed in the aforementioned embodiment, Examples, and modifications, any structure capable of attaining the same operation or function.

What is claimed is:

1. An electron emitter comprising an emitter section formed of a thin layer of a dielectric material containing PMN-PT-PZ and having a mechanical quality factor of more than 100;

a first electrode provided on a front surface of the emitter section; and a second electrode provided on the front surface of the emitter section, or on a reverse surface of the emitter section opposite the front surface.

2. An electron emitter as described in claim 1, wherein a gap is formed between a peripheral portion of the first electrode and the front surface of the emitter section.

3. An electron emitter as described in claim 2, the electron emitter further comprising a substrate which is provided on the reverse surface side of the emitter section and which supports the emitter section, wherein the emitter section is bonded onto a surface of the substrate.

4. An electron emitter as described in claim 3, wherein the second electrode is bonded onto the surface of the substrate, and the emitter section is bonded onto the second electrode.

5. An electron emitter as described in claim 1, the electron emitter further comprising a substrate which is provided on the reverse surface side of the emitter section and which supports the emitter section, wherein the emitter section is bonded onto a surface of the substrate.

6. An electron emitter as described in claim 5, wherein the second electrode is bonded onto the surface of the substrate, and the emitter section is bonded onto the second electrode.

7. An electron emitter as described in claim 1, wherein the dielectric material does not contain Bi.

* * * * *